US009947265B2

(12) United States Patent
Park et al.

(10) Patent No.: US 9,947,265 B2
(45) Date of Patent: Apr. 17, 2018

(54) ELECTROLUMINESCENT DISPLAY DEVICE AND METHOD OF DRIVING THE SAME TO COMPENSATE FOR DEGENERATION OF PIXELS

(71) Applicant: SAMSUNG DISPLAY CO., LTD., Yongin, Gyeonggi-Do (KR)

(72) Inventors: Jong-Woong Park, Yongin-si (KR); Jae-Shin Kim, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 65 days.

(21) Appl. No.: 14/692,054

(22) Filed: Apr. 21, 2015

(65) Prior Publication Data

US 2016/0140895 A1 May 19, 2016

(30) Foreign Application Priority Data

Nov. 13, 2014 (KR) ..... 10-2014-0157528

(51) Int. Cl.
*G09G 3/3208* (2016.01)

(52) U.S. Cl.
CPC ... *G09G 3/3208* (2013.01); *G09G 2320/0233* (2013.01); *G09G 2320/0285* (2013.01); *G09G 2320/043* (2013.01); *G09G 2320/045* (2013.01); *G09G 2360/16* (2013.01)

(58) Field of Classification Search
None
See application file for complete search history.

(56) References Cited

U.S. PATENT DOCUMENTS

2011/0191042 A1* 8/2011 Chaji ..... G09G 3/32 702/64
2012/0256971 A1* 10/2012 Shin ..... G09G 3/3233 345/690
2014/0292342 A1* 10/2014 Chaji ..... G09G 3/006 324/414

FOREIGN PATENT DOCUMENTS

| | | |
|---|---|---|
| JP | 2010-169991 | 8/2010 |
| KR | 10-2014-0075040 A | 6/2014 |
| KR | 10-2014-0075061 A | 6/2014 |
| KR | 10-2015-0082807 | 7/2015 |

* cited by examiner

*Primary Examiner* — David D Davis
(74) *Attorney, Agent, or Firm* — Lee & Morse, P.C.

(57) ABSTRACT

A method for driving an electroluminescent display device includes grouping pixels in a display panel into a plurality of pixel groups, each pixel group including a plurality of rows and a plurality of columns. Accumulated block stress values are provided based on input image data. Each accumulated block stress value represents a degree of degeneration of the pixels in each pixel block. Corrected stress values are provided by correcting each accumulated block stress value based on the accumulated block stress values of the adjacent pixel blocks. Input image data is corrected based on the corrected stress values.

17 Claims, 16 Drawing Sheets

ELECTROLUMINESCENT DISPLAY DEVICE AND METHOD OF DRIVING THE SAME TO COMPENSATE FOR DEGENERATION OF PIXELS

CROSS-REFERENCE TO RELATED APPLICATION

Korean Patent Application No. 10-2014-0157528, filed on Nov. 13, 2014, and entitled, "Electroluminescent Display Device and Method Of Driving The Same To Compensate For Degeneration Of Pixels," is incorporated by reference herein in its entirety.

BACKGROUND

1. Field

One or more embodiments described herein relate to an electroluminescent display device and a method for driving an electroluminescent display device to compensate for degeneration of pixels.

2. Description of the Related Art

An electroluminescent display may have a fast response speed and low power consumption compared with other types of displays. This improved performance may be achieved, at least in part, through the use of pixels that use light emitting diodes or organic light-emitting diodes (OLEDs). For example, an OLED emits light based on a recombination of electrons and holes in a light-emitting layer located between an anode and a cathode. The light-emitting layer includes a material that emits light based on the driving current flowing between the anode and the cathode. The luminance of the light is based on the amount of driving current, e.g., higher driving currents may produce higher brightness of light in the displayed image.

In an electroluminescent display, the pixels may become stressed and degenerate depending, for example, on the driving currents. The degeneration may worsen with increased amounts of stress over time. As a result, a luminance drop may occur which degrades display quality.

SUMMARY

In accordance with one or more embodiments, a method for driving an electroluminescent display device, the method comprising grouping pixels in a display panel into a plurality of pixel groups, each of the pixel groups including a plurality of rows and a plurality of columns; providing accumulated block stress values based on input image data, each accumulated block stress value representing a degree of degeneration of the pixels in each pixel block; providing corrected stress values by correcting each accumulated block stress value based on the accumulated block stress values of the adjacent pixel blocks; and correcting the input image data based on the corrected stress values.

The operation of providing the corrected stress values may include estimating a stress boundary position in each pixel block based on the accumulated block stress values of the adjacent pixel blocks; and correcting the accumulated block stress value in each pixel block based on the stress boundary position in each pixel block to provide the corrected stress values.

The operation of providing the corrected stress values may include performing a filtering operation of the corrected stress values, wherein the filtering operation varies the corrected stress values of the pixels near the stress boundary position.

The operation of providing the accumulated block stress values may include calculating block average values based on the input image data of each frame, each block average value representing an average grayscale value of the pixels in each pixel block; and accumulating each block average value with respect to a plurality of frames to store the accumulated block stress values.

The operation of providing the corrected stress values may include providing the corrected stress value of a first pixel block based on a first accumulated block stress value of the first pixel block, a second accumulated block stress value of a second pixel block adjacent to a left side of the first pixel block, and a third accumulated block stress value of a third pixel block adjacent to a right side of the first pixel block.

The operation of providing the corrected stress value of the first pixel block may include determining whether the first accumulated block stress value is an increasing type or a decreasing type, by comparing difference values among the first, second, and third accumulated block stress values with at least one reference value; when the first accumulated block stress value is determined to be the increasing type and the decreasing type, estimating a stress boundary position in the first pixel block based on the difference values; and correcting the first accumulated block stress value in the first pixel block based on the stress boundary position in the first pixel block in order to provide the corrected stress value of the first pixel block.

The operation of providing the corrected stress value of the first pixel block may include when the first accumulated block stress value is determined to not be the increasing type or the decreasing type, providing the first accumulated block stress value without correction as the corrected stress value of the first pixel block.

The operation of determining whether the first accumulated block stress value is the increasing type or the decreasing type may include calculating a first difference value by subtracting the first accumulated block stress value from the third accumulated block stress value; calculating a second difference value by subtracting the second accumulated block stress value from the first accumulated block stress value; determining that the first accumulated block stress value is the increasing type when both of the first difference value and the second difference value are greater than a positive reference value; and determining that the first accumulated block stress value is the decreasing type when both of the first difference value and the second difference value are smaller than a negative reference value.

The operation of estimating the stress boundary position in the first pixel block may include calculating a third difference value by subtracting the second accumulated block stress value from the third accumulated block stress value; calculating a proportion value by dividing the first difference value by the third difference value; and calculating the stress boundary position based on the proportion value.

The operation of correcting the first accumulated block stress value in the first pixel block may include providing the second accumulated block stress value as the corrected stress value with respect to the pixels disposed at the left side of the stress boundary position in the first pixel block; and providing the third accumulated block stress value as the corrected stress value with respect to the pixels disposed at the right side of the stress boundary position in the first pixel block.

The operation of correcting the first accumulated block stress value in the first pixel block may include performing a filtering operation of the corrected stress values of the first pixel block, wherein the filtering operation includes varying the corrected stress values of the first pixel block near the stress boundary position.

The operation of providing the corrected stress values may include providing the corrected stress value of a first pixel block based on a first accumulated block stress value of the first pixel block, a second accumulated block stress value of a second pixel block adjacent to a left side of the first pixel block, a third accumulated block stress value of a third pixel block adjacent to a right side of the first pixel block, a fourth accumulated block stress value of a fourth pixel block adjacent to a top side of the first pixel block and a fifth accumulated block stress value of a fifth pixel block adjacent to a bottom side of the first pixel block.

The operation of providing the corrected stress value of the first pixel block may include determining whether the first accumulated block stress value is an increasing type or a decreasing type in a row direction, by comparing difference values among the first, second, and third accumulated block stress values with at least one reference value; determining whether the first accumulated block stress value is the increasing type or the decreasing type in a column direction, by comparing difference values between the first, fourth and fifth accumulated block stress values with the at least one reference value; when the first accumulated block stress value is determined to be the increasing type or the decreasing type in the row direction or the column direction, estimating a stress boundary position in the first pixel block based on the difference values; and correcting the first accumulated block stress value in the first pixel block based on the stress boundary position in the first pixel block, to provide the corrected stress value of the first pixel block.

The operation of determining whether the first accumulated block stress value is the increasing type or the decreasing type in the row direction may include calculating a first row-directional difference value by subtracting the first accumulated block stress value from the third accumulated block stress value; calculating a second row-directional difference value by subtracting the second accumulated block stress value from the first accumulated block stress value; determining that the first accumulated block stress value is the increasing type in the row direction when both of the first row-directional difference value and the second row-directional difference value are greater than a positive reference value; and determining that the first accumulated block stress value is the decreasing type in the row direction when both of the first row-directional difference value and the second row-directional difference value are smaller than a negative reference value.

The operation of determining whether the first accumulated block stress value is the increasing type or the decreasing type in the column direction may include calculating a first column-directional difference value by subtracting the first accumulated block stress value from the fifth accumulated block stress value; calculating a second column-directional difference value by subtracting the fourth accumulated block stress value from the first accumulated block stress value; determining that the first accumulated block stress value is the increasing type in the column direction when both of the first column-directional difference value and the second column-directional difference value are greater than the positive reference value; and determining that the first accumulated block stress value is the decreasing type in the column direction when both of the first column-directional difference value and the second column-directional difference value are smaller than the negative reference value.

The operation of estimating the stress boundary position in the first pixel block may include, when the first accumulated block stress value is determined to be the increasing type or the decreasing type in the row direction, calculating a third row-directional difference value by subtracting the second accumulated block stress value from the third accumulated block stress value; calculating a row-directional proportion value by dividing the first row-directional difference value by the third row-directional difference value; and calculating a row-directional stress boundary position based on the row-directional proportion value.

The operation of estimating the stress boundary position in the first pixel block may include, when the first accumulated block stress value is determined to be the increasing type or the decreasing type in the column direction, calculating a third column-directional difference value by subtracting the fourth accumulated block stress value from the fifth accumulated block stress value; calculating a column-directional proportion value by dividing the first column-directional difference value by the third column-directional difference value; and calculating a column-directional stress boundary position based on the column-directional proportion value.

The operation of correcting the first accumulated block stress value in the first pixel block may include when the first accumulated block stress value is determined to be the increasing type or the decreasing type in the row direction and that the first accumulated block stress value is not the increasing type or the decreasing type in the column direction, providing the second accumulated block stress value as the corrected stress value with respect to the pixels at the left side of the row-directional stress boundary position in the first pixel block and providing the third accumulated block stress value as the corrected stress value with respect to the pixels at the right side of the row-directional stress boundary position in the first pixel block; and when first accumulated block stress value is determined to be the increasing type or the decreasing type in the column direction and that the first accumulated block stress value is not the increasing type or the decreasing type in the row direction, providing the fourth accumulated block stress value as the corrected stress value with respect to the pixels disposed at the top side of the column-directional stress boundary position in the first pixel block and providing the fifth accumulated block stress value as the corrected stress value with respect to the pixels disposed at the bottom side of the column-directional stress boundary position in the first pixel block.

When the first accumulated block stress value is determined to be the increasing type or the decreasing type in the row direction and the first accumulated block stress value is the increasing type or the decreasing type in the column direction, a first absolute value of a difference between the second accumulated block stress value and the third accumulated block stress value may be compared with a second absolute value of a difference between the fourth accumulated block stress value and the fifth accumulated block stress value, and the first accumulated block stress value may be corrected with respect to only one of the row direction and the column direction based on the comparison result to provide the corrected stress value of the first pixel block.

In accordance with one or more other embodiments, an electroluminescent display device includes a display panel including a plurality of pixels; degeneration compensating logic to: group the pixels in the display panel into pixel groups, each including a plurality of rows and a plurality of columns, provide accumulated block stress values based on input image data, each accumulated block stress value corresponding to a degree of degeneration of the pixels in each pixel block, provide corrected stress values by correcting each accumulated block stress value based on the accumulated block stress values of the adjacent pixel blocks and correct the input image data based on the corrected stress values; and a data driver to drive the pixels in the display panel based on the corrected input image data.

BRIEF DESCRIPTION OF THE DRAWINGS

Features will become apparent to those of skill in the art by describing in detail exemplary embodiments with reference to the attached drawings in which.

DESCRIPTION OF EMBODIMENTS

Figure 1:
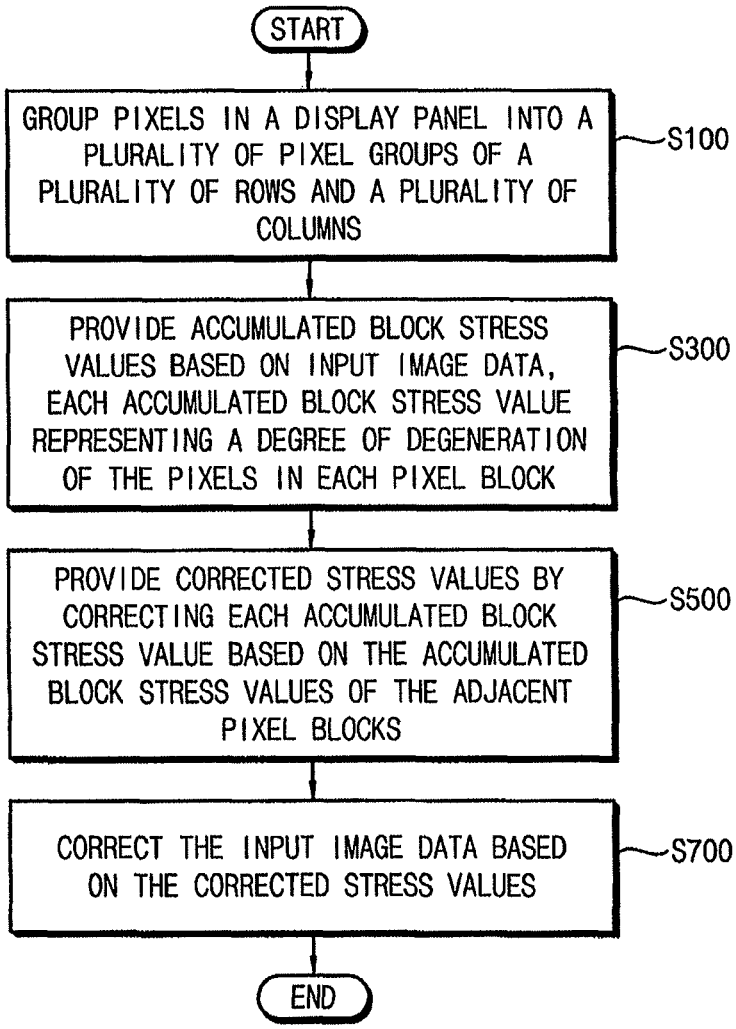
FIG. 1 illustrates an embodiment of a method for driving an electroluminescent display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout. Embodiments may be combined to form additional embodiments.

FIG. 1 illustrates an embodiment of a method for driving an electroluminescent display device. The method includes grouping pixels in a display panel into a plurality of pixel groups of a plurality of rows and a plurality of columns (S100). An example of how pixels may be grouped is described with reference to FIG. 5. In a subsequent operation, accumulated block stress values are provided based on input image data, where each accumulated block stress value represents a degree of degeneration of the pixels in each pixel block (S300).

In one example embodiment, block average values may be calculated based on input image data of each frame, where each block average value represents an average grayscale value of the pixels in each pixel block. Each block average value may be accumulated with respect to a plurality of frames to store and provide the accumulated block stress values. The degeneration of the pixels may be efficiently compensated by reducing the data amount of the stress values through grouping of the pixels.

The method further includes providing corrected stress values by correcting each accumulated block stress value based on the accumulated block stress values of the adjacent pixel blocks (S500). The input image data are corrected based on the corrected stress values (S700). The corrected input image data are provided to a data driver to drive the pixels in the display panel.

In one example embodiment, a stress boundary position in each pixel block may be estimated based on the accumulated block stress values of one or more adjacent pixel blocks. The accumulated block stress value in each pixel block may be corrected based on the stress boundary position in each pixel block, to provide the accumulated block stress values. As such, degeneration of the pixels may be efficiently compensated by estimating the stress boundary position in each pixel block and correcting the accumulated block stress values based on the stress boundary position.

Figure 2:
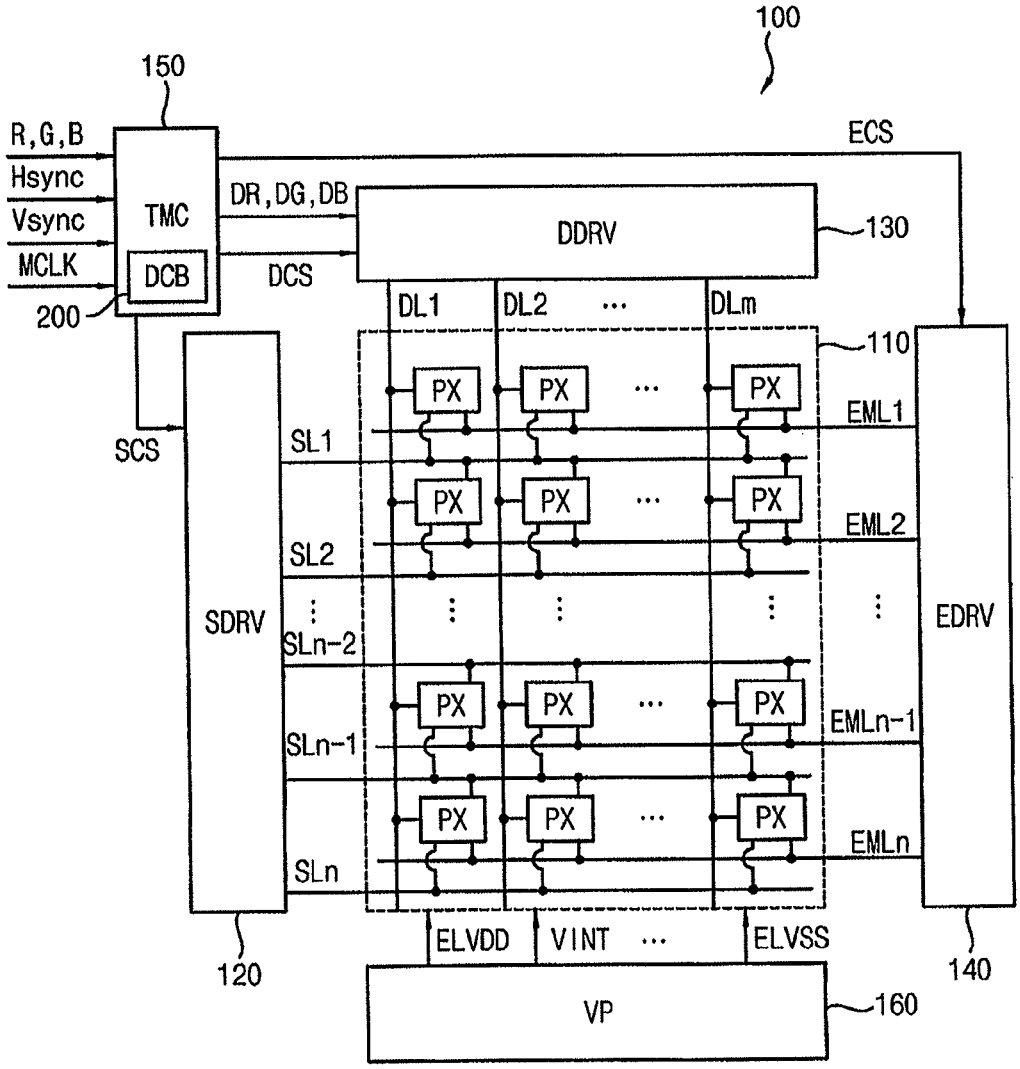
FIG. 2 illustrates an embodiment of an electroluminescent display.

FIG. 2 illustrates an embodiment of an electroluminescent display device or display module 100 which includes a light-emitting diode (LED) or an organic light-emitting diode (OLED) that emits light based on recombination of electrons and holes. The display device 100 includes a display panel 110 having a plurality of pixels PX, a scan driver SDRV 120, a data driver DDRV 130, an emission control driver EDRV 140, a timing controller TMC 150, a degeneration compensating block DCB 200, and a voltage providing circuit VP 160.

The pixels PX may be disposed in a matrix including rows and columns. For example, the pixels PX may be located at respective cross portions of row control lines SL1~SLn, data lines DL1~DLm, and emission control lines EML1~EMLn. Each pixel PX may include a plurality of sub pixels. For example, each pixel PX may include a red sub pixel, a green sub pixel and a blue sub pixel arranged in a row direction.

In this case, each of the data lines DL1~DLm in FIG. 2 may include three signal lines for driving the RGB sub pixels, respectively.

The pixels PX may receive a positive power supply voltage ELVDD, a negative power supply voltage ELVSS, an initialization voltage VINT, etc., from the voltage providing circuit 160. The scan driver 120 may provide row control signals to the pixels PX by units of rows through the row control lines SL1~SLn. The data driver 130 may provide data signals to the pixels PX by units of columns through data lines DL1~DLm. The emission control driver 140 may provide emission control signals to the pixels PX by units of rows through emission control lines EML1~EMLn.

The timing controller 150 may receive input image data R, G, B, for example, from an external source, and may provide corrected image data DR, DG, DB to the data driver 130. The timing controller 150 may receive a vertical synchronization signal Vsync, a horizontal synchronization signal Hsync, and a clock signal MCLK from the external device and generate control signals for the scan driver 120, the data driver 130 and the emission control driver 140. The timing controller 150 provides scan driving control signals SCS to the scan driver 120, data driving control signals DCS to the data driver 130, and emission driving control signals ECS to the emission control driver 140, respectively. Each pixel PX emits light based on a driving current flowing through the LED or the OLED based on the data signals from the data lines DL1~DLm.

The degeneration compensating block 200 generates values corresponding to groups of pixels PX in the display panel 100. The pixel groups may include pixels in a plurality of rows and a plurality of columns. The degeneration compensating block 200 provides accumulated block stress values based on the input image data, where each accumulated block stress value represents a degree of degeneration of the pixels PX in a corresponding pixel block.

The degeneration compensating block 200 provides corrected stress values by correcting each accumulated block stress value based on the accumulated block stress values of the adjacent pixel blocks, and corrects the input image data based on the corrected stress values. FIG. 2 illustrates a non-limiting example where the degeneration compensating block 200 is in the timing controller 150. In this case, the degeneration compensating block 200 may be implemented out of the timing controller 150.

Figure 3:
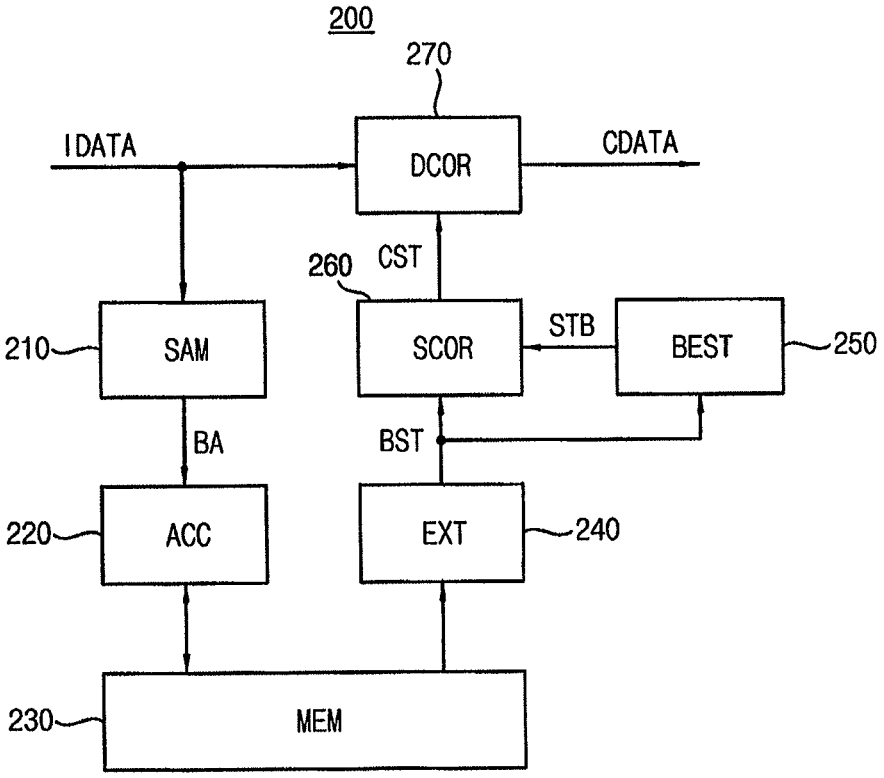
FIG. 3 illustrates an example of a degeneration compensating block.

FIG. 3 illustrates an embodiment of a degeneration compensating block 200, which, for example, may be include din the electroluminescent display device 100 of FIG. 2. Referring to FIG. 3, the degeneration compensating block 200 includes a sampling unit SAM 210, an accumulating unit ACC 220, a memory unit MEM 230, an extracting unit 240, a boundary estimating unit BEST 250, a stress correcting unit SCOR 260, and a data correcting unit DCOR 270.

The sampling unit 210 may calculate and provide block average values BA based on input image data IDATA of each frame. Each block average value BA may be an average grayscale value of the pixels in each pixel block. The accumulating unit 220 may accumulate each block average value BA with respect to a plurality of frames to store the accumulated block stress values. For example, whenever the input image data IDATA of a new frame are provided, the accumulating unit 220 may read out the previous accumulated block stress values BST stored in the memory unit 230, add the block average values BA of the new frame to the read values BST, and then store the added values as the new accumulated block stress values BST in the memory unit 230.

The extracting unit 240 may extract the accumulated block stress values BST of the adjacent pixel blocks from the memory unit 230 and provide the extracted values BST to the boundary estimating unit 250. The boundary estimating unit 250 may estimate and provide a stress boundary position STB in each pixel block based on the accumulated block stress values BST of the adjacent pixel blocks.

The stress correcting unit 260 may correct the accumulated block stress value BST in each pixel block based on the stress boundary position STB in each pixel block to provide the corrected stress values CST. The data correcting unit 270 may correct the input image data IDATA based on the corrected stress values CST to provide the corrected input image data CDATA. The corrected stress values CST may be provided by units of pixels to represent the degree of degeneration of the corresponding pixel. The data correcting unit 270 may provide the corrected input image data CDATA to compensate for the luminance drop corresponding to the degeneration of each pixel.

Figure 4:
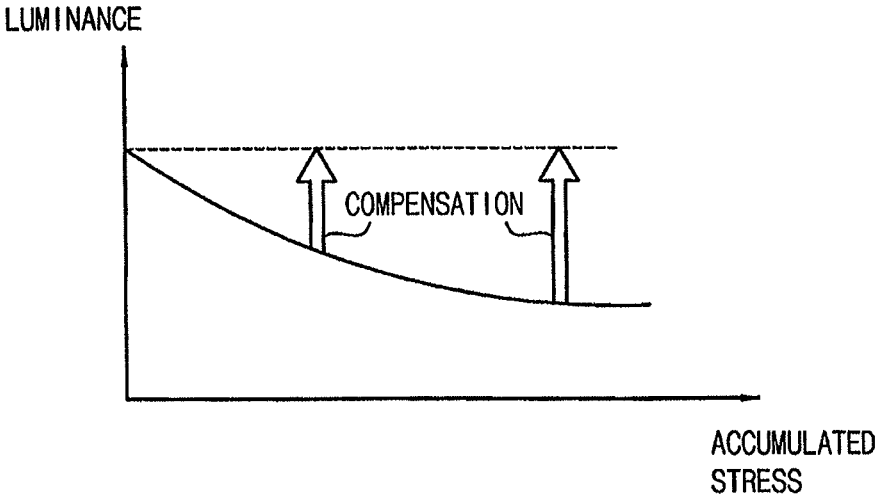
FIG. 4 illustrates an example of a luminance drop caused by accumulated stress on pixels.

FIG. 4 illustrates an example of a luminance drop that may occur as a result of accumulated stress of pixels. Referring to FIG. 4, the luminance drop may increase as the accumulated stress increases or degeneration of the pixel becomes more severe. The luminance drop, and a fluctuation in luminance drop, may degrade the quality of a displayed image. To reduce or prevent these effects, luminance may be compensated based on the degree of degeneration that has taken place, or which is estimated to take place, in the respective pixels. For example, luminance may be increased with increases in accumulated stress.

In one embodiment, the accumulated stress of a pixel may correspond to a brightness of the displayed image, e.g., the grayscale values of the input image data. The amount of the luminance compensation may be anticipated based on information corresponding to the accumulation of the grayscale values of the respective pixels. The stress data (e.g., the accumulated grayscale values) may be stored in a non-volatile memory device such as a flash memory device. The amount of the stress data per pixel may increase significantly as the resolution of the display panel and/or the number of accumulated frames is increased. This may result in an increase in hardware costs and the bandwidth of data from and to the non-volatile memory device for storing the stress data. In accordance with one embodiment, these effects may be reduced or prevented by grouping pixels in the manner corresponding to FIG. 5.

Figure 5:
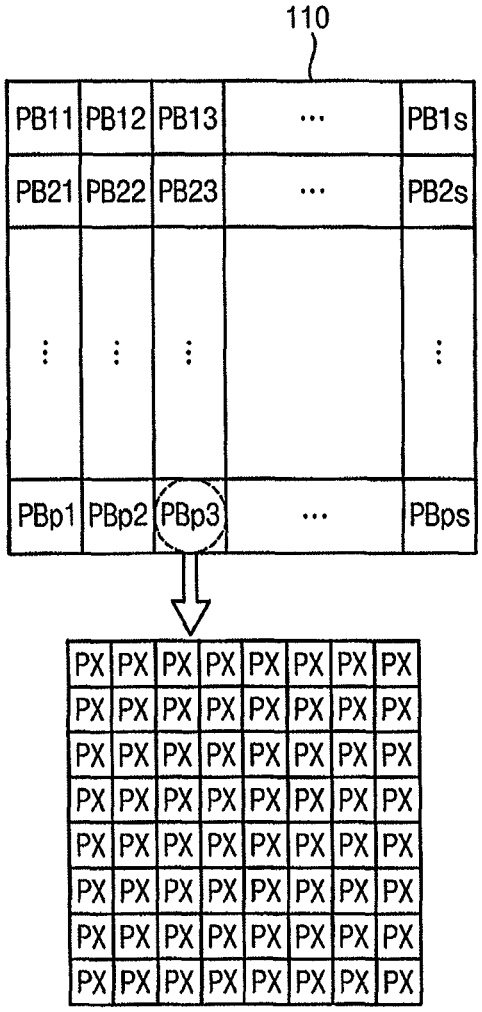
FIG. 5 illustrates an example of how pixels may be grouped.

FIG. 5 illustrates an example of grouping pixels for the method of FIG. 1. Referring to FIG. 5, the pixels in the display panel 110 in FIG. 2 may be grouped into a plurality of pixel groups PB11~PBps of a plurality of rows and a plurality of columns, where p indicates the number of rows and s the number of columns.

Each of the pixel groups PB11~PBps may be, for example, an 8*8 block including 64 pixels as illustrated in FIG. 5. The amount of the stress data may be reduced significantly by accumulating the block average values BA and by storing and providing accumulated block stress values BST, where each block average value BA is an average grayscale value of the pixels in each pixel block. When the stress data are provided through such compression by units of the pixel blocks, the boundary of the stressed regions may not be reflected exactly. Thus, errors may occur. For example, the errors in luminance compensation may be significant when compensating for the degeneration of pixels using the accumulated block stress values.

Figure 6:
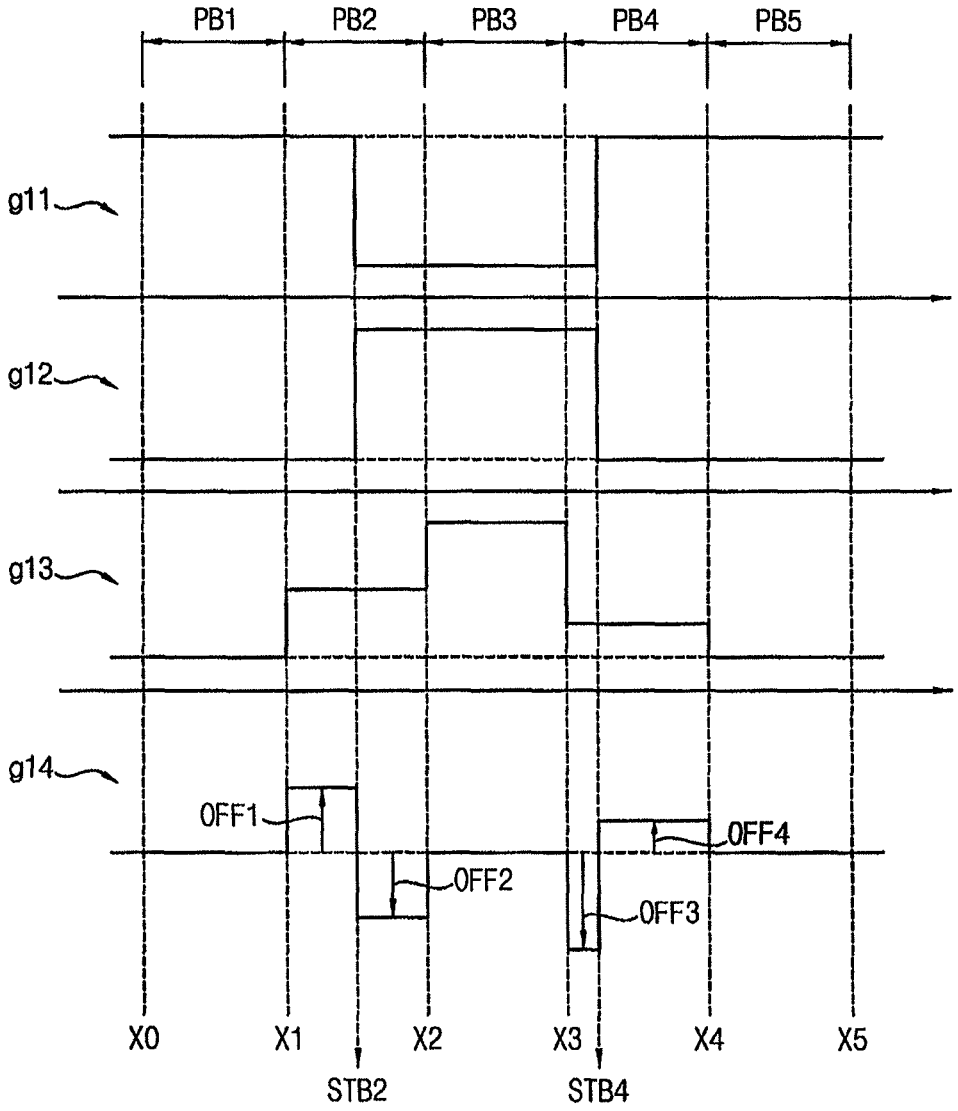
FIG. 6 illustrates example of errors that may occur when compensating for degeneration of pixels using accumulated block stress values.

FIG. 6 illustrates examples of errors that may occur when compensating for degeneration of pixels using accumulated block stress values. In FIG. 6, the horizontal axis represents a position of pixels and X0~X5 represent boundary positions of pixel blocks PB1~PB5 adjacent in a row direction. The waveform g11 represents an example of a real luminance drop, the waveform g12 represents a corresponding real accumulated stress, the waveform g13 represents corresponding accumulated block stress values, and the waveform g14 represents an example of corresponding errors of the luminance compensation based on the accumulated block stress values. The accumulated block stress values are provided by units of pixel blocks, and thus the luminance compensation errors may be caused when the stress boundary positions STB2 and STB4 do not coincide with the pixel boundary positions X0~X5.

For example, the luminance compensation may be excessive as the cases OFF1 and OFF4 or the luminance compensation may be insufficient as the cases OFF2 and OFF3, as in FIG. 6. According to one example embodiment, degeneration of the pixels may be compensated further efficiently by estimating the stress boundary positions STB2 and STB4 in the pixel blocks PB2 and PB4 and correcting the accumulated block stress values based on the stress boundary position STB2 and STB4.

Figure 7:
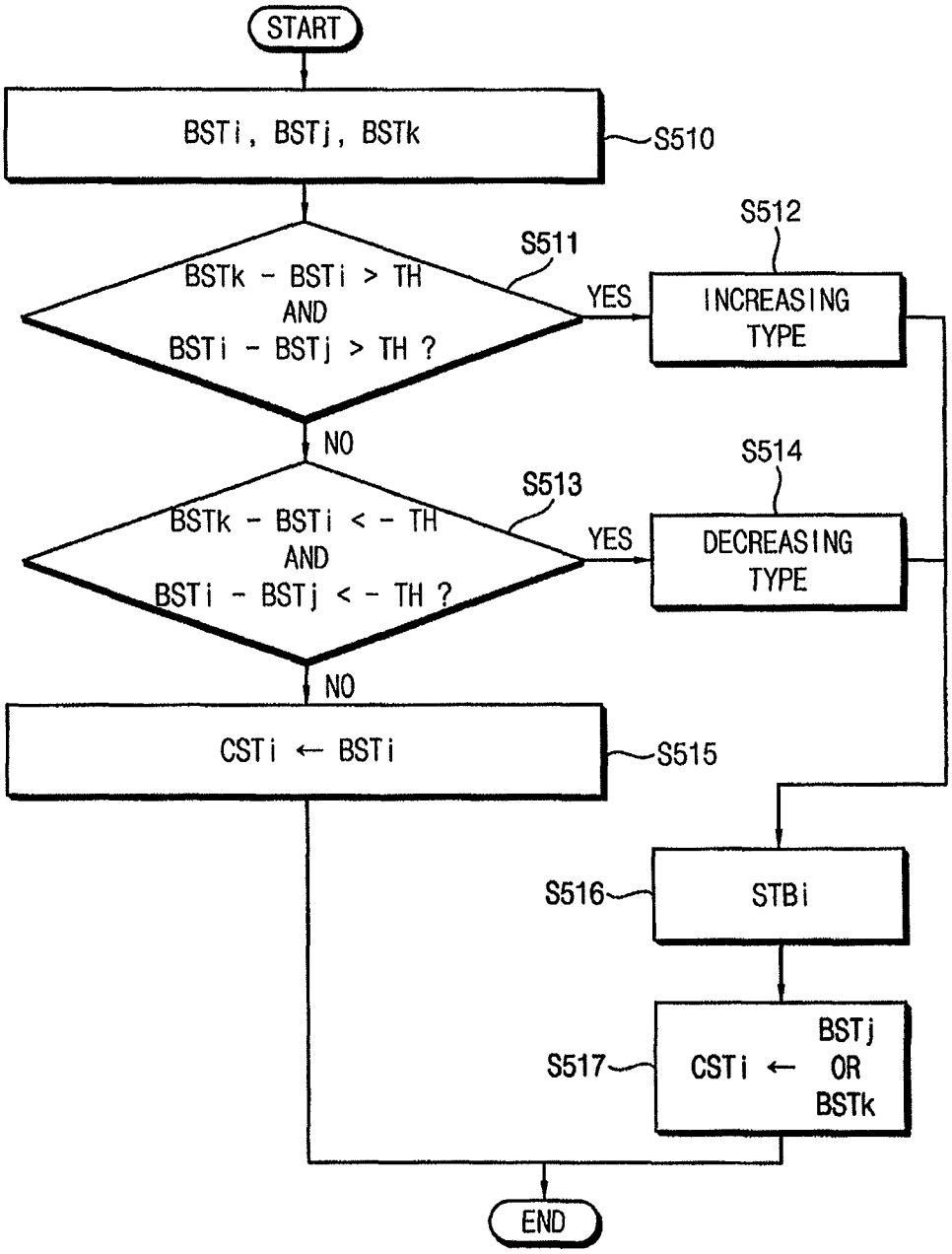
FIG. 7 illustrates an embodiment for correcting an accumulated block stress value.

FIG. 7 illustrates an embodiment of a method for correcting an accumulated block stress value. Referring to FIGS. 3 and 7, the extracting unit 240 may extract and provide the accumulated block stress values of one or more adjacent pixel blocks from the memory unit 230 (S510). For example, the extracting unit 240 may extract and provide a first accumulated block stress value BSTi of the first pixel block PBi, a second accumulated block stress value BSTj of a second pixel block PBj adjacent to a left side of the first pixel block PBi, and a third accumulated block stress value BSTk of a third pixel block PBk adjacent to a right side of the first pixel block PBi.

The boundary estimating unit 250 may determine whether the first accumulated block stress value BSTi is an increasing type or a decreasing type. This may be accomplished, for example, by comparing difference values among the first, second, and third accumulated block stress values BSTi, BSTj, and BSTk with at least one reference value (S511, S513).

For example, the boundary estimating unit 250 may calculate a first difference value BSTk−BSTi by subtracting the first accumulated block stress value BSTi from the third accumulated block stress value BSTk, and a second difference value BSTi−BSTj by subtracting the second accumulated block stress value BSTj from the first accumulated block stress value BSTi. The boundary estimating unit 250 may determine that the first accumulated block stress value BSTi is an increasing type (S512) when both the first difference value BSTk−BSTi and the second difference value BSTi−BSTj are greater than a positive reference value TH (S511: YES). The boundary estimating unit 250 may determine that the first accumulated block stress value BSTi is a decreasing type (S514) when both the first difference value BSTk−BSTi and the second difference value BSTi−BSTj are smaller than a negative reference value −TH (S513: YES).

When it is determined that the first accumulated block stress value BSTi is an increasing type or a decreasing type (S512 or S514), the boundary estimating unit 250 may estimate a stress boundary position STBi in the first pixel block PBi based on the difference values between the first, second, and third accumulated block stress values BSTi, BSTj, and BSTk (S516). The stress correcting unit 260 may correct the first accumulated block stress value BSTi in the first pixel block PBi based on the stress boundary position STBi in the first pixel block PBi, and may provide the corrected stress value of the first pixel block PBi (S517). As will be described with reference to FIGS. 8, 9, and 10, the stress correcting unit 260 may provide the second accumulated block stress value BSTj or the third accumulated block stress value BSTk as the corrected stress value CSTi of the first pixel block PBi based on the stress boundary position STBi.

When the boundary estimating unit 250 determines that the first accumulated block stress value BSTi is not one of an increasing type or decreasing type, the stress correcting unit 260 may provide the first accumulated block stress value BSTi without correction as the corrected stress value CSTi of the first pixel block PBi (S515).

Figure 8:
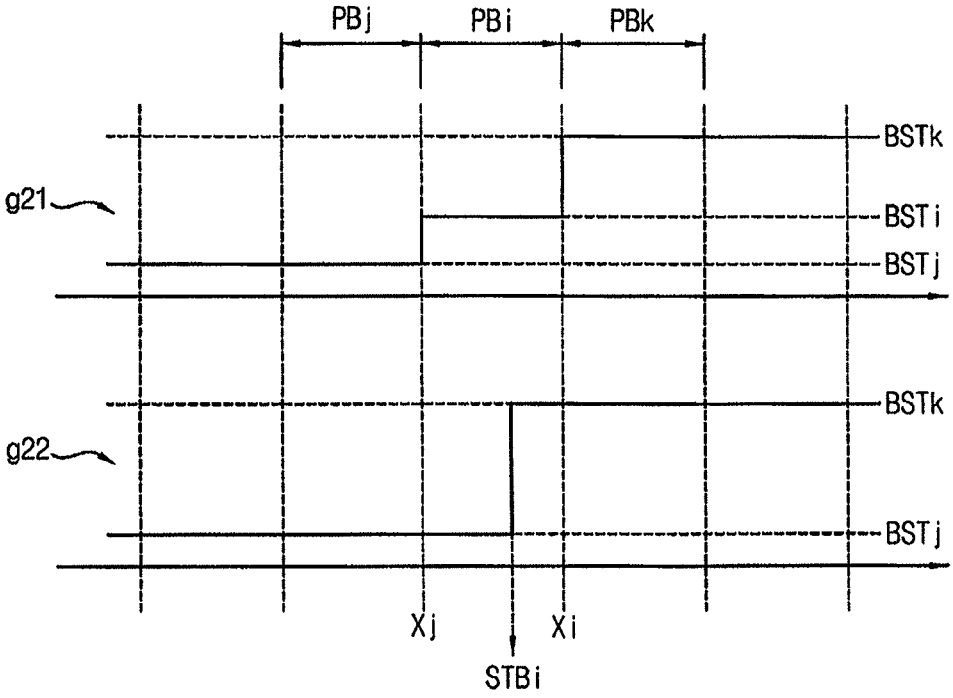
FIG. 8 illustrates an example of an accumulated block stress value that is an increasing type.
Figure 9:
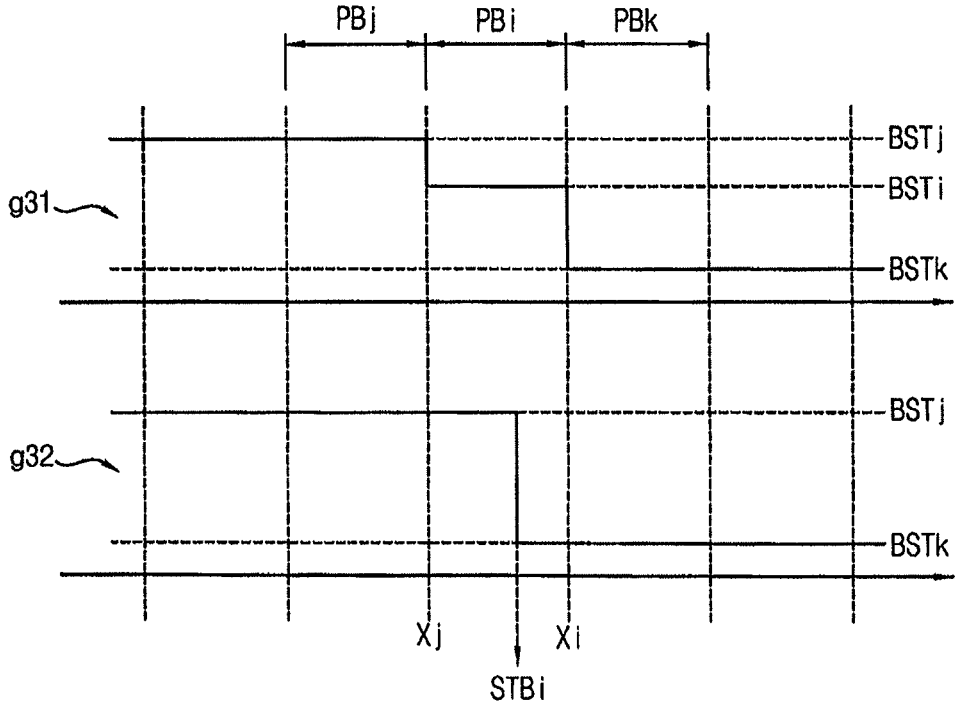
FIG. 9 illustrates an example of an accumulated block stress value that is a decreasing type.
Figure 10:
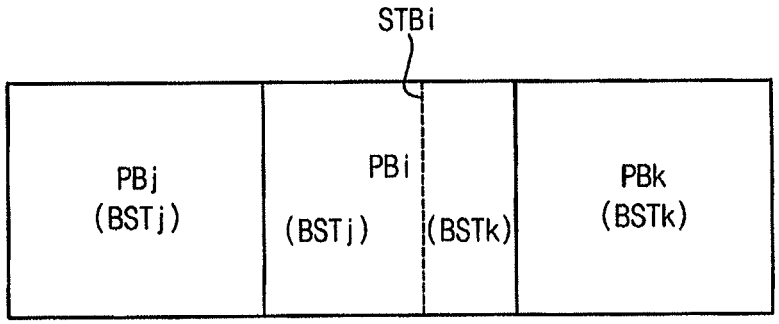
FIG. 10 illustrates an example of a corrected stress value when an accumulated block stress value is an increasing type or a decreasing type.

FIG. 8 illustrates an example case of an accumulated block stress value that is an increasing type. FIG. 9 illustrates an example case of an accumulated block stress value is a decreasing type. FIG. 10 illustrates a corrected stress value of an accumulated block stress value is an increasing and a decreasing type.

In FIGS. 8 and 9, the horizontal axis represents a position of pixels and Xj and Xk represent boundary positions of both sides of the first pixels PBi. The waveforms g21 and g31 represent example accumulated block stress values, and the waveforms g22 and 32 represent the corresponding corrected stress values, respectively.

Referring to FIG. 8, the third accumulated block stress value BSTk of the third pixel block PBk is greater than the first accumulated block stress value BSTi of the first pixel block PBi. Also, the first accumulated block stress value BSTi is greater than the second accumulated block stress value BSTj of the second pixel block PBj. As described with reference to FIGS. 3 and 7, the boundary estimating unit 250 may determine that the first accumulated block stress value BSTi is an increasing type when both the first difference value BSTk−BSTi and the second difference value BSTi−BSTj are greater than the positive reference value TH. When it is determined that the first accumulated block stress value BSTi is an increasing type, the boundary estimating unit 250 may estimate the stress boundary position STBi in the first pixel block PBi based on the difference values between the first, second, and third accumulated block stress values BSTi, BSTj and BSTk.

For example, the boundary estimating unit 250 may calculate a third difference value BSTk−BSTj by subtracting the second accumulated block stress value BSTj from the third accumulated block stress value BSTk, and a proportion value (BSTk−BSTi)/(BSTk−BSTj) by dividing the first difference value BSTk−BSTi by the third difference value BSTk−BSTj. The boundary estimating unit 250 may calculate the stress boundary position STBi based on the proportion value (BSTk−BSTi)/(BSTk−BSTj). For example, the stress boundary position STBi may be determined such that the distance between the positions Xj and STBi may be proportional to the proportion value (BSTk−BSTi)/(BSTk−BSTj).

Referring to FIG. 9, the third accumulated block stress value BSTk of the third pixel block PBk is smaller than the first accumulated block stress value BSTi of the first pixel block PBi, and the first accumulated block stress value BSTi is smaller than the second accumulated block stress value BSTj of the second pixel block PBj. As described with reference to FIGS. 3 and 7, the boundary estimating unit 250 may determine that the first accumulated block stress value BSTi is a decreasing type when both the first difference value BSTk−BSTi and the second difference value BSTi−BSTj are smaller than the negative reference value −TH. When it is determined that the first accumulated block stress value BSTi is a decreasing type, the boundary estimating unit 250 may estimate the stress boundary position STBi in the first pixel block PBi based on the difference values between the first, second, and third accumulated block stress values BSTi, BSTj and BSTk.

For example, the boundary estimating unit 250 may calculate a third difference value BSTk−BSTj by subtracting the second accumulated block stress value BSTj from the third accumulated block stress value BSTk, and a proportion value (BSTk−BSTi)/(BSTk−BSTj) by dividing the first difference value BSTk−BSTi by the third difference value BSTk−BSTj. The boundary estimating unit 250 may calculate the stress boundary position STBi based on the proportion value (BSTk−BSTi)/(BSTk−BSTj). For example, the stress boundary position STBi may be determined such that the distance between the positions Xj and STBi may be proportional to the proportion value (BSTk−BSTi)/(BSTk−BSTj).

Referring to FIG. 10, when it is determined that the first accumulated block stress value BSTi is an increasing type or a decreasing type, the stress correcting unit 260 may provide the second accumulated block stress value BSTj or the third accumulated block stress value BSTk as the corrected stress value CSTi of the first pixel block PBi based on the stress boundary position STBi. The stress correcting unit 260 may provide the second accumulated block stress value BSTj as the corrected stress value with respect to the pixels disposed at the left side of the stress boundary position STBi in the first pixel block PBi. In contrast, the stress correcting unit 260 may provide the third accumulated block stress value BSTk as the corrected stress value with respect to the pixels disposed at the right side of the stress boundary position STBi in the first pixel block PBi. Such corrections of the first accumulated block stress value BSTi of the first pixel block PBi based on the stress boundary position STBi are illustrated by the waveform g22 of FIG. 8 and the waveform g32 of FIG. 9.

Figure 11A:
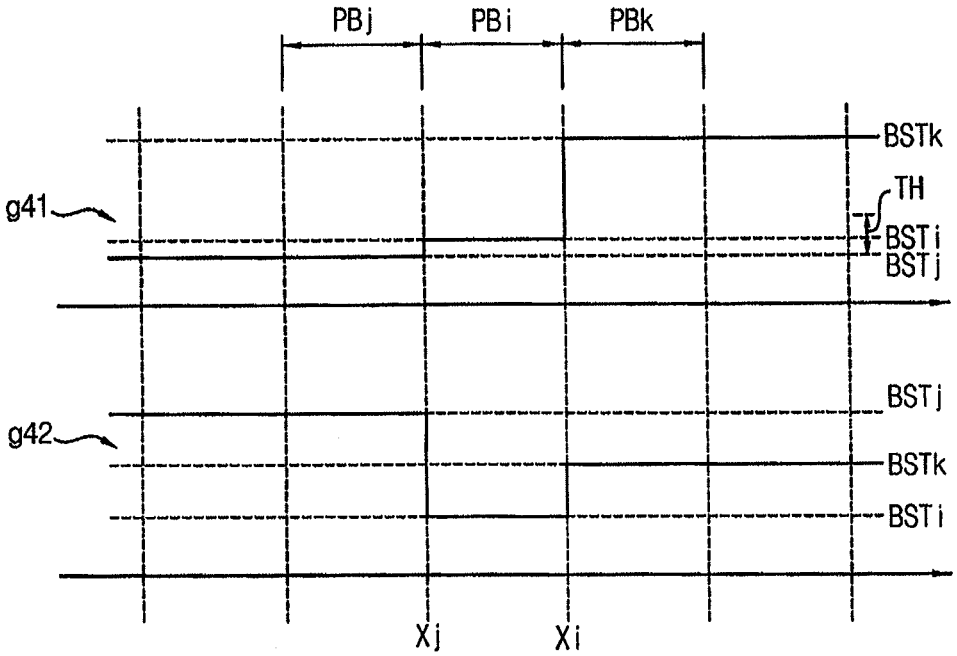
FIG. 11A illustrates an example of an accumulated block stress value that is not an increasing type or a decreasing type.
Figure 11B:
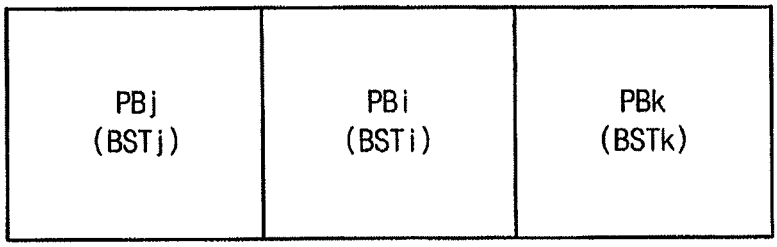
FIG. 11B illustrates an example of a corrected stress value for an accumulated block stress value is not an increasing type or a decreasing type.

FIG. 11A illustrates example cases for an accumulated block stress value that is not an increasing type or a decreasing type, and FIG. 11B illustrates a corrected stress value for an accumulated block stress value that is not an increasing or decreasing type.

Referring to the waveform g41 in FIG. 11A, the third accumulated block stress value BSTk of the third pixel block PBk is greater than the first accumulated block stress value BSTi of the first pixel block PBi, and the first accumulated block stress value BSTi is greater than the second accumulated block stress value BSTj of the second pixel block PBj. Even though the accumulated block stress values BSTj, BSTi, and BSTk are increasing with respect to the three consecutive pixel blocks PBj, PBi, and PBk, it is determined that the first accumulated block stress value BSTi is not an increasing type because the second difference value BSTi−BSTj is smaller than the positive reference value TH.

Referring to the waveform g42 in FIG. 11A, the third accumulated block stress value BSTk of the third pixel block PBk is greater than the first accumulated block stress value BSTi of the first pixel block PBi, and the first accumulated block stress value BSTi is smaller than the second accumulated block stress value BSTj of the second pixel block PBj. In this case, it is determined that the first accumulated block stress value BSTi is not an increasing type or a decreasing type because the accumulated block stress values BSTj, BSTi, and BSTk are not increasing or decreasing with respect to the three consecutive pixel blocks PBj, PBi, and PBk.

Referring to FIG. 11B, when it is determined that the first accumulated block stress value BSTi is not an increasing type or a decreasing type, the boundary estimating unit 250 may not provide the stress boundary position in the first pixel block PBi, and the stress correcting unit 260 may provide the first accumulated block stress value BSTi without correction as the corrected stress value of the first pixel block PBi.

Figure 12:
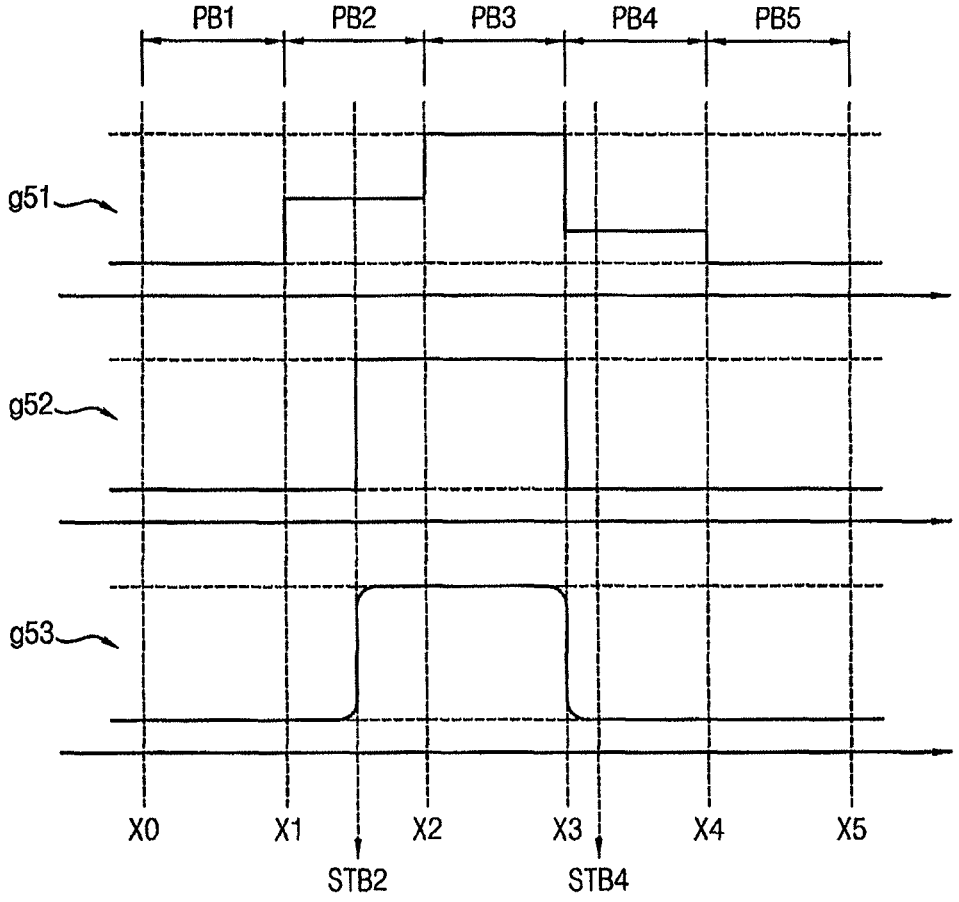
FIG. 12 illustrates an embodiment of a filtering operation.

FIG. 12 illustrates an embodiment of a filtering operation. In FIG. 12, the horizontal axis represents positions of pixels and X0~X5 represent boundary positions of pixel blocks PB1~PB5 adjacent in a row direction. The waveform g51 represents example accumulated block stress values, the waveform g52 represents the corresponding corrected stress values, and the waveform g53 illustrates a result of the filtering operation performed on the corrected stress values of the waveform g52. The filtering operation of the corrected stress values may be performed to vary (e.g., gradually) the corrected stress values of the pixels near the stress boundary positions STB2 and STB4. For example, the filtering operation may be a smoothing filtering operation which involves replacing the corrected stress value of each pixel with an average value of the corrected stress values of the predetermined number of pixels adjacent in the row direction.

Figure 13:
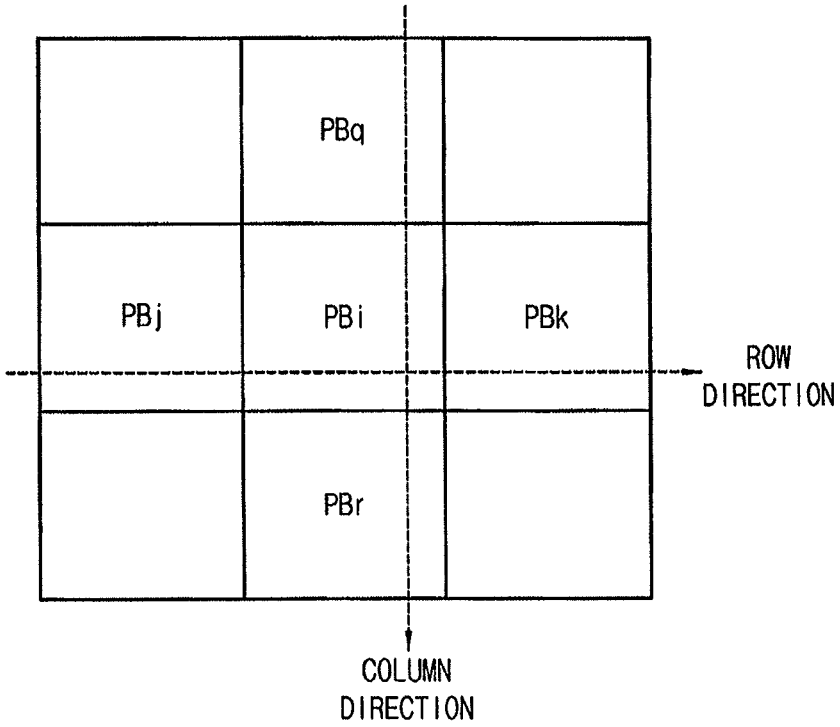
FIG. 13 illustrates an example of reference pixel blocks for two-dimensional correction of an accumulated block stress value.

FIG. 13 illustrates an example of reference pixel blocks for two-dimensional correction of an accumulated block stress value. The example in FIG. 13 includes a first pixel block PBi, a second pixel block PBj adjacent to a left side of the first pixel block PBi, a third pixel block PBk adjacent to the first pixel block PBi, a fourth pixel block PBq adjacent to a top side of the first pixel block PBi, and a fifth pixel block PBr adjacent to the bottom side of the first pixel block PBi. The accumulated block stress value BSTi may be corrected by referring to the accumulated block stress values of the two adjacent blocks PBj and PBk in the row direction and the two pixel blocks PBq and PBr in the column direction.

Figure 14:
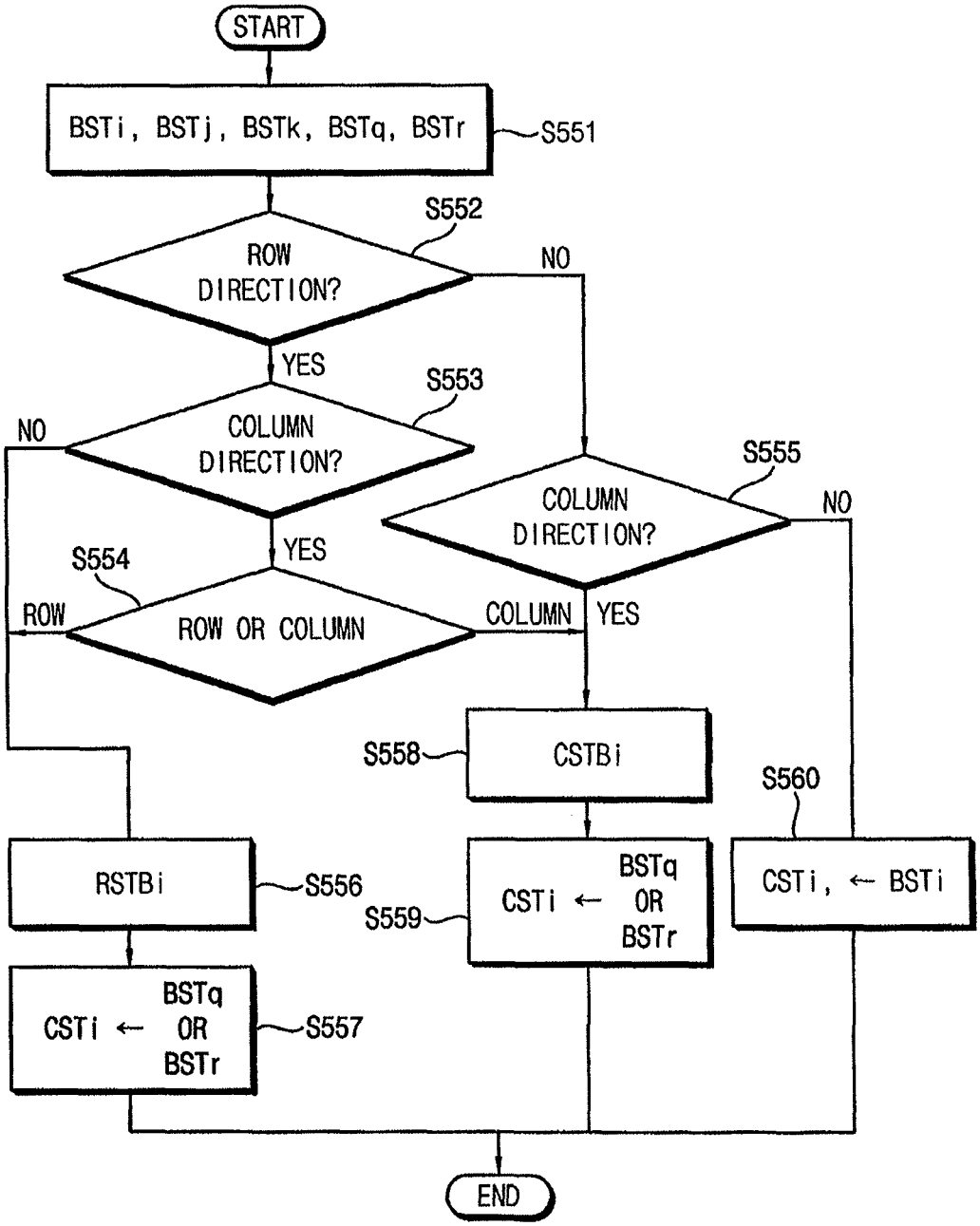
FIG. 14 illustrates an embodiment for performing two-dimensional correction of an accumulated block stress value.

FIG. 14 illustrates an embodiment of a method for performing two-dimensional correction of an accumulated block stress value. Referring to FIGS. 3 and 14, the extracting unit 240 may extract and provide the accumulated block stress values of the adjacent pixel blocks from the memory unit 230 (S551). For example, the extracting unit 240 may extract and provide a first accumulated block stress value BSTi of the first pixel block PBi, a second accumulated block stress value BSTj of a second pixel block PBj adjacent to a left side of the first pixel block PBi, a third accumulated block stress value BSTk of a third pixel block PBk adjacent to a right side of the first pixel block PBi, a fourth accumulated block stress value BSTq of a fourth pixel block PBq adjacent to a top side of the first pixel block PBi, and a fifth accumulated block stress value BSTr of a fifth pixel block PBr adjacent to a bottom side of the first pixel block PBi.

The boundary estimating unit 250 may determine whether the first accumulated block stress value BSTi is an increasing type or a decreasing type in the row direction. This may be accomplished, for example, by comparing row-directional difference values among the first, second, and third accumulated block stress values BSTi, BSTj, and BSTk with at least one reference value (S552).

As described above with reference to FIG. 7, the boundary estimating unit 250 may calculate a first row-directional difference value BSTk−BSTi by subtracting the first accumulated block stress value BSTi from the third accumulated block stress value BSTk, and a second row-directional difference value BSTi−BSTj by subtracting the second accumulated block stress value BSTj from the first accumulated block stress value BSTi. The boundary estimating unit 250 may determine that the first accumulated block stress value BSTi is an increasing type in the row direction when both the first row-directional difference value BSTk−BSTi and the second row-directional difference value BSTi−BSTj are greater than a positive reference value TH. The boundary estimating unit 250 may determine that the first accumulated block stress value BSTi is a decreasing type in the row direction when both the first row-directional difference value BSTk−BSTi and the second row-directional difference value BSTi−BSTj are smaller than a negative reference value −TH (S552: YES).

The boundary estimating unit 250 may determine whether the first accumulated block stress value BSTi is an increasing type or a decreasing type in the column direction. This may be accomplished, for example, by comparing column-directional difference values between the first, fourth, and fifth accumulated block stress values BSTi, BSTq, and BSTr with the at least one reference value (S553).

As described above, the boundary estimating unit 250 may calculate a first column-directional difference value BSTr−BSTi by subtracting the first accumulated block stress value BSTi from the fifth accumulated block stress value BSTr, and a second column-directional difference value BSTi−BSTq by subtracting the fourth accumulated block stress value BSTq from the first accumulated block stress value BSTi. The boundary estimating unit 250 may determine that the first accumulated block stress value BSTi is an increasing type in the column direction when both the first column-directional difference value BSTr−BSTi and the second column-directional difference value BSTi−BSTq are greater than the positive reference value TH. The boundary estimating unit 250 may determine that the first accumulated block stress value BSTi is a decreasing type in the column direction when both the first column-directional difference value BSTr−BSTi and the second column-directional difference value BSTi−BSTq are smaller than the negative reference value −TH (S553: YES or S555: YES).

When the first accumulated block stress value BSTi is determined to be an increasing type or a decreasing type in the row direction (S552: YES) and the first accumulated block stress value BSTi is not an increasing type and a decreasing type in the column direction (S553: NO), the boundary estimating unit 250 may estimate a row-directional stress boundary position RSTBi in the first pixel block PBi based on the row-directional difference values between the first, second and third accumulated block stress values BSTi, BSTj, and BSTk (S556).

For example, the boundary estimating unit 250 may calculate a third row-directional difference value BSTk−BSTj by subtracting the second accumulated block stress value BSTj from the third accumulated block stress value BSTk, and a row-directional proportion value (BSTk−BSTi)/(BSTk−BSTj) by dividing the first row-directional difference value BSTk−BSTi by the third row-directional difference value BSTk−BSTj. The boundary estimating unit 250 may calculate the row-directional stress boundary position RSTBi based on the row-directional proportion value (BSTk−BSTi)/(BSTk−BSTj).

The stress correcting unit 260 may correct the first accumulated block stress value BSTi in the first pixel block PBi based on the row-directional stress boundary position RSTBi in the first pixel block PBi, to provide the corrected stress value of the first pixel block PBi (S557). For example, the stress correcting unit 260 may provide the second accumulated block stress value BSTj as the corrected stress value CSTi with respect to the pixels at the left side of the row-directional stress boundary position RSTBi in the first pixel block PBi. In contrast, the stress correcting unit 260 may provide the third accumulated block stress value BSTk as the corrected stress value CSTi with respect to the pixels at the right side of the row-directional stress boundary position RSTBi in the first pixel block PBi.

When it is determined that the first accumulated block stress value BSTi is not an increasing type or a decreasing type in the row direction (S552: NO) and the first accumulated block stress value BSTi is an increasing type or a decreasing type in the column direction (S553: YES), the boundary estimating unit 250 may estimate a column-directional stress boundary position CSTBi in the first pixel block PBi based on the row-directional difference values between the first, fourth, and fifth accumulated block stress values BSTi, BSTq, and BSTr (S558).

For example, the boundary estimating unit 250 may calculate a third column-directional difference value BSTq−BSTr by subtracting the fourth accumulated block stress value BSTq from the fifth accumulated block stress value BSTr, and a column-directional proportion value (BSTr−BSTi)/(BSTr−BSTq) by dividing the first column-directional difference value BSTr−BSTi by the third column-directional difference value BSTr−BSTq. The boundary estimating unit 250 may calculate the column-directional stress boundary position CSTBi based on the column-directional proportion value (BSTr−BSTi)/(BSTr−BSTq).

The stress correcting unit 260 may correct the first accumulated block stress value BSTi in the first pixel block PBi based on the column-directional stress boundary position CSTBi in the first pixel block PBi, to provide the corrected stress value of the first pixel block PBi (S559). For example, the stress correcting unit 260 may provide the fourth accumulated block stress value BSTq as the corrected stress value CSTi with respect to the pixels at the top side of the column-directional stress boundary position CSTBi in the first pixel block PBi. In contrast, the stress correcting unit 260 may provide the fifth accumulated block stress value BSTr as the corrected stress value CSTi with respect to the pixels at the bottom side of the column-directional stress boundary position CSTBi in the first pixel block PBi.

When it is determined that the first accumulated block stress value BSTi is an increasing type or decreasing type in the row direction (S552: YES) and the first accumulated block stress value BSTi is an increasing type and or decreasing type in the column direction (S553: YES), the boundary estimating unit 250 may compare a first absolute value |BSTk−BSTj| of the row-directional difference between the second accumulated block stress value BSTj and the third accumulated block stress value BSTk with a second absolute value |BSTq−BSTr| of the column-directional difference between the fourth accumulated block stress value BSTq and the fifth accumulated block stress value BSTr. The first accumulated block stress value BSTi may be corrected with respect to only one of the row direction or column direction based on the comparison result to provide the corrected stress value of the first pixel block PBi.

For example, when the first absolute value |BSTk−BSTj| is greater than the second absolute value |BSTr−BSTq| (S554: ROW), the first accumulated block stress value BSTi may be corrected with respect to only the row direction to provide the corrected stress value of the first pixel block PBi (S556, S557). In contrast, when the first absolute value |BSTk−BSTj| is smaller than the second absolute value |BSTr−BSTq| (S554: COLUMN), the first accumulated block stress value BSTi may be corrected with respect to only the column direction to provide the corrected stress value of the first pixel block PBi (S558, S559).

When the boundary estimating unit 250 determines that the first accumulated block stress value BSTi is not an increasing type or decreasing type in the row direction (S552: NO) and the first accumulated block stress value BSTi is not an increasing type or decreasing type in the column direction (S555: NO), the stress correcting unit 260 may provide the first accumulated block stress value BSTi without correction as the corrected stress value CSTi of the first pixel block PBi (S560).

Figure 15:
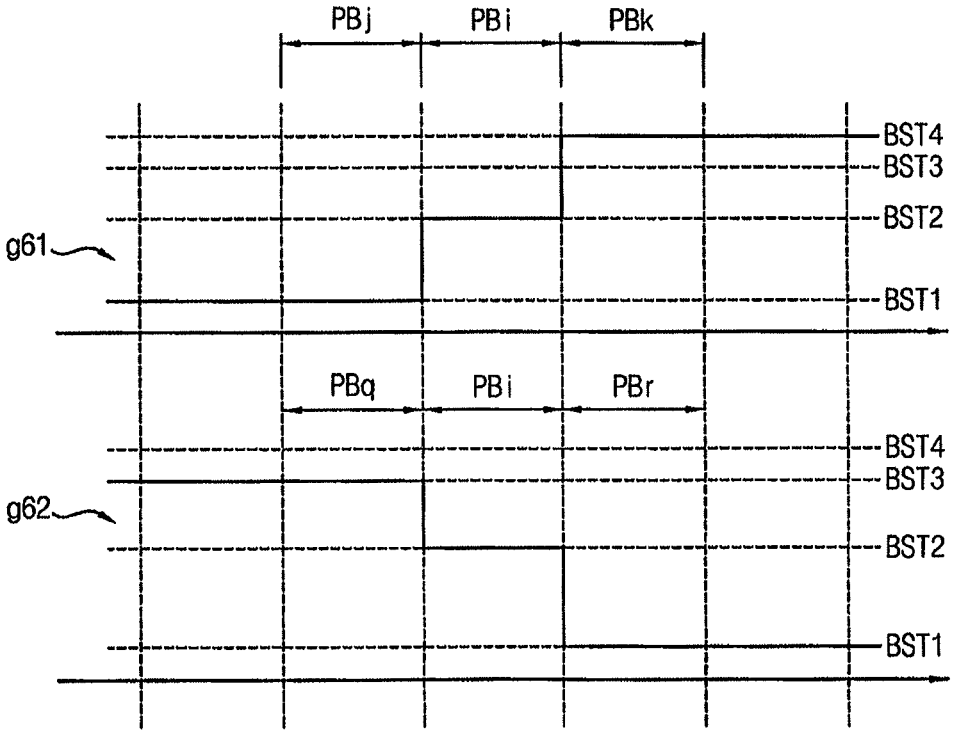
FIG. 15 illustrates an embodiment of an accumulated block stress value that is an increasing type in a row direction.
Figure 16:
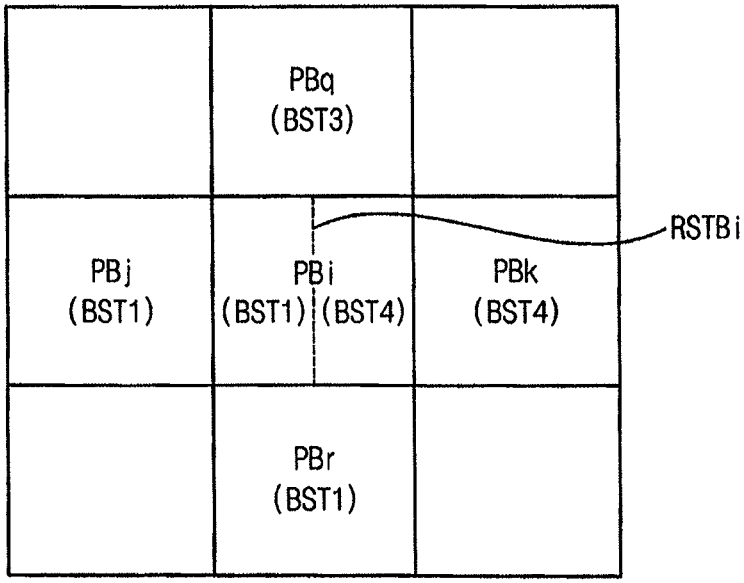
FIG. 16 illustrates an embodiment of a corrected stress value for an accumulated block stress value corrected in a row direction.

FIG. 15 illustrates an example when an accumulated block stress value is an increasing type in a row direction, and FIG. 16 illustrating an example of a corrected stress value when an accumulated block stress value is corrected in a row direction.

In FIG. 15, the waveform 61 represents the accumulated block stress values of the pixel blocks PBj, PBi, and PBk adjacent in the row direction, and the waveform 62 represents the accumulated block stress values of the pixel blocks PBq, PBi, and PBr adjacent in the column direction. The example of FIG. 15 represents a case that the accumulated block stress value of the center pixel block PBi is an increasing type in the row direction and simultaneously a decreasing type in the column direction.

As described with reference to FIG. 14, the accumulated block stress value of the center pixel block PBi may be corrected with respect to only the row direction because the row-directional absolute value (|BSTk−BSTj|=BST4−BST1) is greater than the column-directional absolute value (|BSTr−BSTq|=BST3−BST1). For example, as illustrated in FIG. 16, the stress correcting unit 260 may provide the accumulated block stress value BST1 of the second pixel block PBj adjacent to the left side of the first pixel block PBi as the corrected stress value CSTi with respect to the pixels at the left side of the row-directional stress boundary position RSTBi in the first pixel block PBi. In contrast, the stress correcting unit 260 may provide the accumulated block stress value BST4 of the third pixel block PBk adjacent to the right side of the first pixel block PBi as the corrected stress value CSTi with respect to the pixels at the right side of the row-directional stress boundary position RSTBi in the first pixel block PBi.

Figure 17:
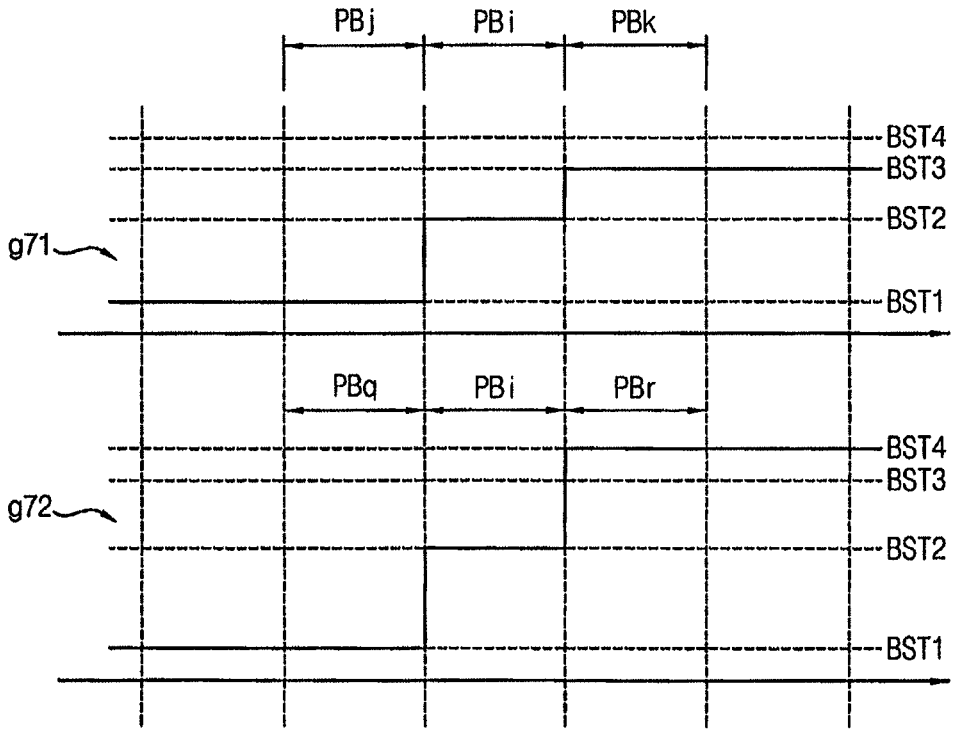
FIG. 17 illustrates an example of an accumulated block stress value that is an increasing type in a column direction.
Figure 18:
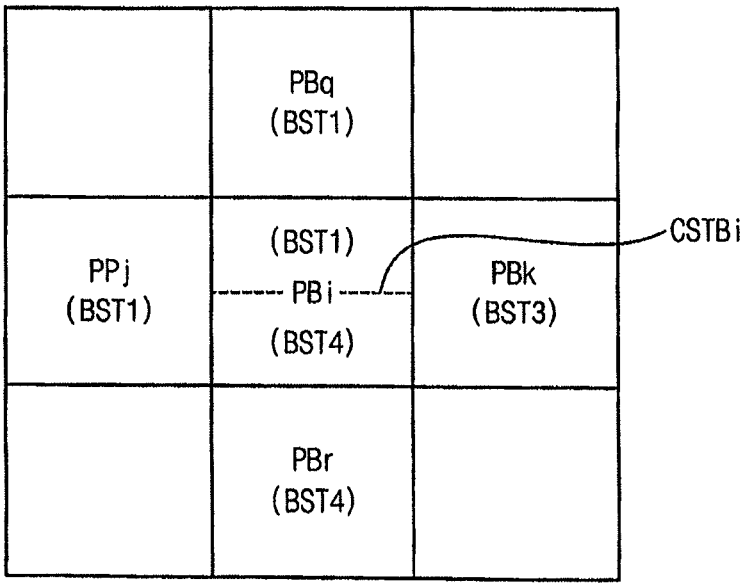
FIG. 18 illustrates an example of a corrected stress value for an accumulated block stress value corrected in a column direction.

FIG. 17 illustrates an example for when an accumulated block stress value is an increasing type in a column direction, and FIG. 18 illustrates of a corrected stress value when an accumulated block stress value is corrected in a column direction. In FIG. 17, the waveform 71 represents the accumulated block stress values of the pixel blocks PBj, PBi and PBk adjacent in the row direction, and the waveform 72 represents the accumulated block stress values of the pixel blocks PBq, PBi, and PBr adjacent in the column direction. The example of FIG. 17 represents a case where the accumulated block stress value of the center pixel block PBi is an increasing type in the row direction and simultaneously an increasing type in the column direction.

As described with reference to FIG. 17, the accumulated block stress value of the center pixel block PBi may be corrected with respect to only the column direction, because the column-directional absolute value (|BSTr−BSTq|=BST4−BST1) is greater than the row-directional absolute value (|BSTk−BSTj|=BST3−BST|). For example, as illustrated in FIG. 18, the stress correcting unit 260 may provide the accumulated block stress value BST1 of the fourth pixel block PBq adjacent to the top side of the first pixel block PBi as the corrected stress value CSTi with respect to the pixels at the top side of the column-directional stress boundary position CSTBi in the first pixel block PBi. In contrast, the stress correcting unit 260 may provide the accumulated block stress value BST4 of the fifth pixel block PBr adjacent to the bottom side of the first pixel block PBi as the corrected stress value CSTi with respect to the pixels at the bottom side of the column-directional stress boundary position CSTBi in the first pixel block PBi.

Figure 19:
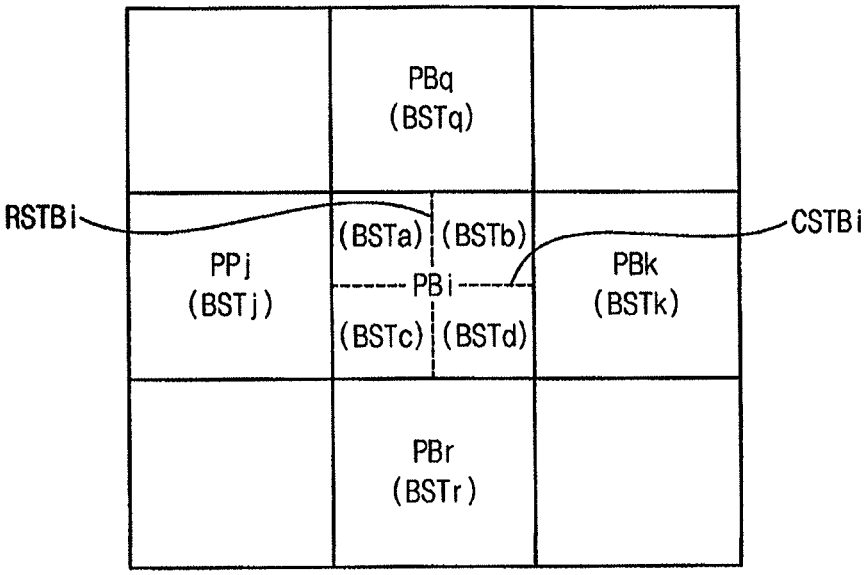
FIG. 19 illustrates an example of a corrected stress value for an accumulated block stress value corrected in a row direction and a column direction.

FIG. 19 illustrates an example of a corrected stress value when an accumulated block stress value is corrected in a row direction and in a column direction. Referring to FIG. 19, when the first accumulated block stress value BSTi is an increasing type or decreasing type in the row direction and simultaneously an increasing type or decreasing type in the column direction, the row-directional stress boundary position CSTBi and the column-directional stress boundary position CSTBi in the first pixel block PBi may be estimated respectively, using the methods described above.

In this case, the first pixel block PBi may be partitioned into four sub blocks having the corrected stress values BSTa, BSTb, BSTc, and BSTd, respectively. For example, the corrected stress value BSTa of the left-top sub block may be an average value (BSTj+BSTq)/2 of the second and fourth pixel blocks PBj and PBq. The corrected stress value BSTb of the right-top sub block may be an average value (BSTk+BSTq)/2 of the third and fourth pixel blocks PBk and PBq. The corrected stress value BSTc of the left-bottom sub block may be an average value (BSTj+BSTr)/2 of the second and fifth pixel blocks PBj and PBr. The corrected stress value BSTd of the right-bottom sub block may be an average value (BSTk+BSTr)/2 of the third and fifth pixel blocks PBk and PBr.

Figure 20:
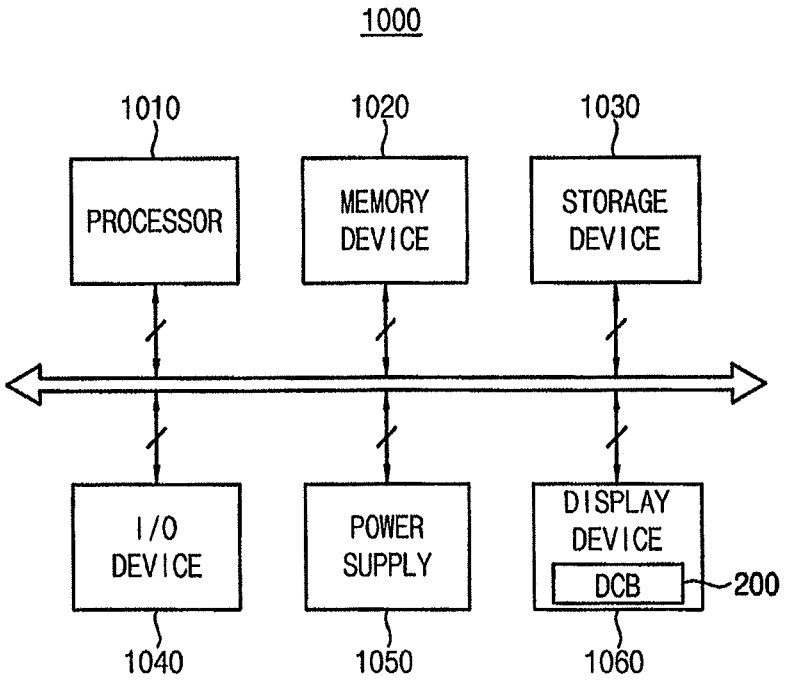
FIG. 20 illustrates an embodiment of an electronic device.

FIG. 20 illustrates an embodiment of an electronic device 1000 which includes a processor 1010, a memory device 1020, a storage device 1030, an input/output (I/O) device 1040, a power supply 1050, and a display device 1060. In addition, the electronic device 1000 may include a plurality of ports for communicating a video card, a sound card, a memory card, a universal serial bus (USB) device, other electronic devices, etc.

The processor 1010 may perform various computing functions. The processor 1010 may be a micro-processor, a central processing unit (CPU), etc. The processor 1010 may be coupled to other components via an address bus, a control bus, a data bus, etc. Further, the processor 1010 may be coupled to an extended bus, such as a peripheral component interconnection (PCI) bus.

The memory device 1020 may store data for operations of the electronic device 1000. For example, the memory device 1020 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device, such as a dynamic random access memory (DRAM) device, a static random access memory (SRAM) device, a mobile dynamic random access memory (mobile DRAM) device, etc. The storage device 1030 may be a solid state drive (SSD) device, a hard disk drive (HDD) device, a CD-ROM device, etc.

The I/O device 1040 may be an input device such as a keyboard, a keypad, a mouse, a touchpad, a touch-screen, a remote controller, etc, and an output device such as a printer, a speaker, etc. In some example embodiments, the display device 1060 may be included in the I/O device 1040. The power supply 1050 may provide a power for operations of the electronic device 1000. The display device 1060 may communicate with other components via the buses or other communication links.

As described above, the display device 1060 may include a degeneration compensating block DCB 200. The degeneration compensating block 200 may generate values for groups of pixels in the display panel, where the pixel groups include a plurality of rows and a plurality of columns. The degeneration compensating block 200 may then provide accumulated block stress values based on input image data, where each accumulated block stress value represents a degree of degeneration of the pixels in each pixel block. The degeneration compensating block 200 may provide corrected stress values by correcting each accumulated block stress value based on the accumulated block stress values of the adjacent pixel blocks and correct the input image data based on the corrected stress values.

The electronic device 1000 may include a display device. For example, the electronic device 1000 may be, for example, a television, a computer monitor, a laptop, a digital camera, a cellular phone, a smart phone, a personal digital assistant (PDA), a portable multimedia player (PMP), an MP3 player, a navigation system, or a video phone.

Figure 21:
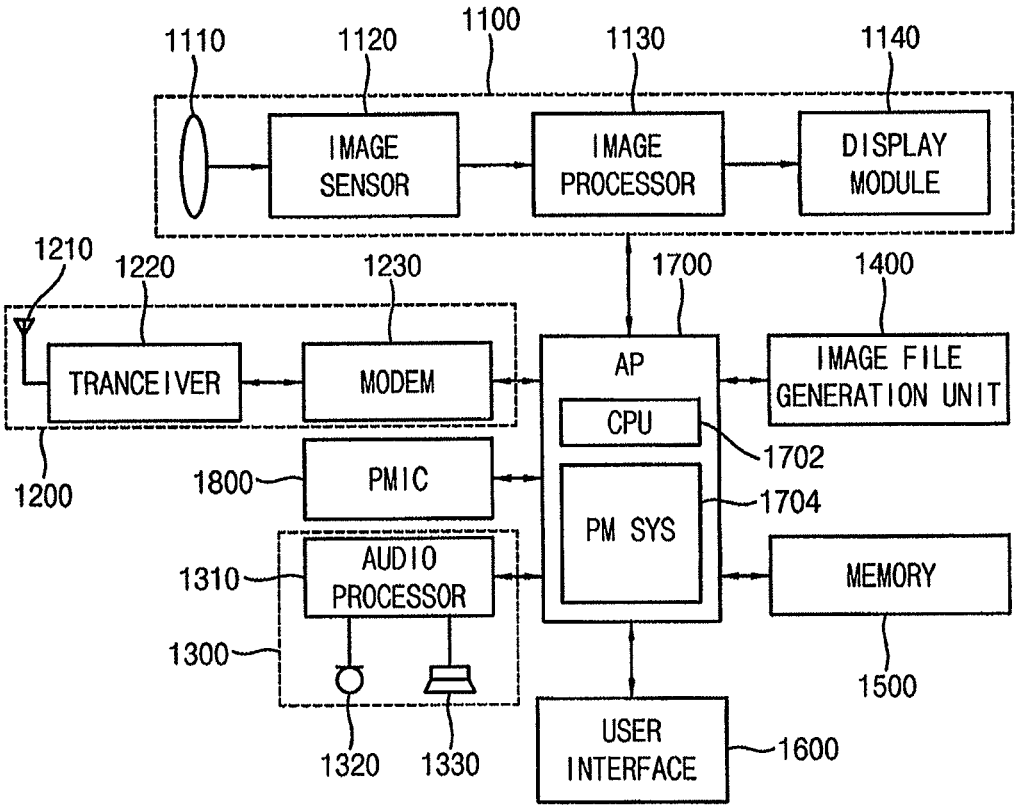
FIG. 21 illustrates an embodiment of a portable terminal.

FIG. 21 illustrates an embodiment of portable terminal 2000 which includes an image processing block 1100, a wireless transceiving block 1200, an audio processing block 1300, an image file generation unit 1400, a memory device 1500, a user interface 1600, an application processor 1700, and a power management integrated circuit (PMIC) 1800.

The image processing block 1100 includes a lens 1110, an image sensor 1120, an image processor 1130, and a display module 1140. The wireless transceiving block 1200 includes an antenna 1210, a transceiver 1220 and a modem 1230. The audio processing block 1300 includes an audio processor 1310, a microphone 1320 and a speaker 1330.

According to example embodiments, the display module 1140 may include a degeneration compensating block. The degeneration compensating block may generate values for groups of pixels in the display panel, where the pixel groups include a plurality of rows and a plurality of columns. The degeneration compensating block may provide accumulated block stress values based on input image data, where each accumulated block stress value represents a degree of degeneration of the pixels in each pixel block. The degeneration compensating block may provide corrected stress values by correcting each accumulated block stress value based on the accumulated block stress values of the adjacent pixel blocks and correct the input image data based on the corrected stress values.

The portable terminal 2000 may include various kinds of semiconductor devices. For example, the application processor 1700 may have low power consumption and high performance. The application processor 1700 may have multiple cores. In one embodiment, the application processor 1700 may include a CPU core 1702 and a power management (PM) system 1704.

The PMIC 1800 may provide driving voltages to the image processing block 1100, the wireless transceiving block 1200, the audio processing block 1300, the image file generation unit 1400, the memory device 1500, the user interface 1600 and the application processor 1700, respectively.

The degeneration compensating blocks, extractors, correction units, controllers, and other processing features of the embodiments described herein may be implemented in logic which, for example, may include hardware, software, or both. When implemented at least partially in hardware, the degeneration compensating blocks, extractors, correction units, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the degeneration compensating blocks, extractors, correction units, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The above described embodiments may be applied to various kinds of devices and systems such as a mobile phone, a smart phone, a tablet computer, a laptop computer, a personal digital assistant PDA, a portable multimedia player PMP, a digital television, a digital camera, a portable game console, a music player, a camcorder, a video player, a navigation system, etc.

By way of summation and review, pixels are stressed and degenerate depending on repeated driving currents. The degeneration becomes more serious as the pixels are more stressed, and luminance drop may be caused by the degeneration of the pixels to degrade quality of the displayed image. Accumulated block stress values may be provided by units of pixel blocks. As a result, luminance compensation errors OFF1~OFF4 may occur when the stress boundary positions STB2 and STB4 do not coincide with the pixel boundary positions X0~X5.

In accordance with one or more of the aforementioned embodiments, an electroluminescent display device and a driving method may compensate for degeneration of pixels by reducing the data amount of the stress values. This may be accomplished by grouping the pixels. In addition, the electroluminescent display device and the driving method may compensate the degeneration of the pixels by estimating the stress boundary position in each pixel block and correcting the accumulated block stress values based on the stress boundary position.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for driving an electroluminescent display device, the method comprising:

grouping pixels in a display panel into a plurality of pixel groups, each of the pixel groups including a plurality of rows and a plurality of columns;

providing accumulated block stress values based on input image data, each accumulated block stress value representing a degree of degeneration of the pixels in a respective pixel block;

providing corrected stress values by correcting each accumulated block stress value based on a stress boundary position for the respective pixel block, the stress boundary position based on the accumulated block stress values of adjacent pixel blocks; and correcting the input image data based on the corrected stress values, wherein providing the corrected stress values includes providing the corrected stress value of a first pixel block based on a first accumulated block stress value of the first pixel block, a second accumulated block stress value of a second pixel block adjacent to a left side of the first pixel block, and a third accumulated block stress value of a third pixel block adjacent to a right side of the first pixel block, and wherein providing the corrected stress value of the first pixel block includes:

determining whether the first accumulated block stress value is an increasing type or a decreasing type, by comparing difference values among the first, second, and third accumulated block stress values with at least one reference value;

when the first accumulated block stress value is determined to be the increasing type and the decreasing type, estimating the stress boundary position in the first pixel block based on the difference values; and correcting the first accumulated block stress value in the first pixel block based on the stress boundary position in the first pixel block in order to provide the corrected stress value of the first pixel block.

2. The method as claimed in claim 1, wherein providing the corrected stress values includes:

estimating the stress boundary position in each pixel block based on the accumulated block stress values of the adjacent pixel blocks; and correcting the accumulated block stress value in each pixel block based on the stress boundary position in each pixel block to provide the corrected stress values.

3. The method as claimed in claim 2, wherein providing the corrected stress values includes:

performing a filtering operation of the corrected stress values, wherein the filtering operation varies the corrected stress values of the pixels near the stress boundary position.

4. The method as claimed in claim 1, wherein providing the accumulated block stress values includes:

calculating block average values based on the input image data of each frame, each block average value representing an average grayscale value of the pixels in each pixel block; and accumulating each block average value with respect to a plurality of frames to store the accumulated block stress values.

5. The method as claimed in claim 1, wherein providing the corrected stress value of the first pixel block includes:

when the first accumulated block stress value is determined to not be the increasing type or the decreasing type, providing the first accumulated block stress value without correction as the corrected stress value of the first pixel block.

6. The method as claimed in claim 1, wherein determining whether the first accumulated block stress value is the increasing type or the decreasing type includes:

calculating a first difference value by subtracting the first accumulated block stress value from the third accumulated block stress value;

calculating a second difference value by subtracting the second accumulated block stress value from the first accumulated block stress value;

determining that the first accumulated block stress value is the increasing type when both of the first difference value and the second difference value are greater than a positive reference value; and determining that the first accumulated block stress value is the decreasing type when both of the first difference value and the second difference value are smaller than a negative reference value.

7. The method as claimed in claim 6, wherein estimating the stress boundary position in the first pixel block includes:

calculating a third difference value by subtracting the second accumulated block stress value from the third accumulated block stress value;

calculating a proportion value by dividing the first difference value by the third difference value; and calculating the stress boundary position based on the proportion value.

8. The method as claimed in claim 7, wherein correcting the first accumulated block stress value in the first pixel block includes:

providing the second accumulated block stress value as the corrected stress value with respect to the pixels disposed at the left side of the stress boundary position in the first pixel block; and providing the third accumulated block stress value as the corrected stress value with respect to the pixels disposed at the right side of the stress boundary position in the first pixel block.

9. The method as claimed in claim 8, wherein correcting the first accumulated block stress value in the first pixel block includes:

performing a filtering operation of the corrected stress values of the first pixel block, wherein the filtering operation includes varying the corrected stress values of the first pixel block near the stress boundary position.

10. The method as claimed in claim 1, wherein providing the corrected stress values includes:

providing the corrected stress value of a fourth accumulated block stress value of a fourth pixel block adjacent to a top side of the first pixel block, and a fifth accumulated block stress value of a fifth pixel block adjacent to a bottom side of the first pixel block.

11. The method as claimed in claim 10, wherein providing the corrected stress value of the first pixel block includes:

determining whether the first accumulated block stress value is an increasing type or a decreasing type in a row direction, by comparing difference values among the first, second, and third accumulated block stress values with at least one reference value;

determining whether the first accumulated block stress value is the increasing type or the decreasing type in a column direction, by comparing difference values between the first, fourth and fifth accumulated block stress values with the at least one reference value;

when the first accumulated block stress value is determined to be the increasing type or the decreasing type in the row direction or the column direction, estimating the stress boundary position in the first pixel block based on the difference values; and correcting the first accumulated block stress value in the first pixel block based on the stress boundary position in the first pixel block, to provide the corrected stress value of the first pixel block.

12. The method as claimed in claim 11, wherein determining whether the first accumulated block stress value is the increasing type or the decreasing type in the row direction includes:

calculating a first row-directional difference value by subtracting the first accumulated block stress value from the third accumulated block stress value;

calculating a second row-directional difference value by subtracting the second accumulated block stress value from the first accumulated block stress value;

determining that the first accumulated block stress value is the increasing type in the row direction when both of the first row-directional difference value and the second row-directional difference value are greater than a positive reference value; and determining that the first accumulated block stress value is the decreasing type in the row direction when both of the first row-directional difference value and the second row-directional difference value are smaller than a negative reference value.

13. The method as claimed in claim 12, wherein determining whether the first accumulated block stress value is the increasing type or the decreasing type in the column direction includes:

calculating a first column-directional difference value by subtracting the first accumulated block stress value from the fifth accumulated block stress value;

calculating a second column-directional difference value by subtracting the fourth accumulated block stress value from the first accumulated block stress value;

determining that the first accumulated block stress value is the increasing type in the column direction when both of the first column-directional difference value and the second column-directional difference value are greater than the positive reference value; and determining that the first accumulated block stress value is the decreasing type in the column direction when both of the first column-directional difference value and the second column-directional difference value are smaller than the negative reference value.

14. The method as claimed in claim 13, wherein estimating the stress boundary position in the first pixel block includes:

when the first accumulated block stress value is determined to be the increasing type or the decreasing type in the row direction, calculating a third row-directional difference value by subtracting the second accumulated block stress value from the third accumulated block stress value;

calculating a row-directional proportion value by dividing the first row-directional difference value by the third row-directional difference value; and calculating a row-directional stress boundary position based on the row-directional proportion value.

15. The method of claim 14, wherein estimating the stress boundary position in the first pixel block includes:

when the first accumulated block stress value is determined to be the increasing type or the decreasing type in the column direction, calculating a third column-directional difference value by subtracting the fourth accumulated block stress value from the fifth accumulated block stress value;

calculating a column-directional proportion value by dividing the first column-directional difference value by the third column-directional difference value; and calculating a column-directional stress boundary position based on the column-directional proportion value.

16. The method as claimed in claim 15, wherein correcting the first accumulated block stress value in the first pixel block includes:

when the first accumulated block stress value is determined to be the increasing type or the decreasing type in the row direction and that the first accumulated block stress value is not the increasing type or the decreasing type in the column direction, providing the second accumulated block stress value as the corrected stress value with respect to the pixels at the left side of the row-directional stress boundary position in the first pixel block and providing the third accumulated block stress value as the corrected stress value with respect to the pixels at the right side of the row-directional stress boundary position in the first pixel block; and when first accumulated block stress value is determined to be the increasing type or the decreasing type in the column direction and that the first accumulated block stress value is not the increasing type or the decreasing type in the row direction, providing the fourth accumulated block stress value as the corrected stress value with respect to the pixels disposed at the top side of the column-directional stress boundary position in the first pixel block and providing the fifth accumulated block stress value as the corrected stress value with respect to the pixels disposed at the bottom side of the column-directional stress boundary position in the first pixel block.

17. The method as claimed in claim 11, wherein:

when the first accumulated block stress value is determined to be the increasing type or the decreasing type in the row direction and the first accumulated block stress value is the increasing type or the decreasing type in the column direction, a first absolute value of a difference between the second accumulated block stress value and the third accumulated block stress value is compared with a second absolute value of a difference between the fourth accumulated block stress value and the fifth accumulated block stress value, and the first accumulated block stress value is corrected with respect to only one of the row direction and the column direction based on the comparison result to provide the corrected stress value of the first pixel block.

* * * * *